United States Patent [19]

Yanz, Jr. et al.

[11] Patent Number: 4,588,089

[45] Date of Patent: May 13, 1986

[54] DISPOSABLE TOOTH BRUSH

[76] Inventors: Rudolph A. Yanz, Jr.; George Spector, both of 233 Broadway RM 3615, New York, N.Y. 10007

[21] Appl. No.: 651,523

[22] Filed: Sep. 17, 1984

[51] Int. Cl.[4] ..... B65D 83/00; A46B 11/00

[52] U.S. Cl. ..... 206/581; 206/63.5; 206/229; 132/84 R; 401/132; 401/268; 15/104.94

[58] Field of Search ..... 206/63.5, 581, 38, 37, 206/229; 132/83 R, 84 R; 401/132, 133, 134, 268; 15/104.94

[56] References Cited

U.S. PATENT DOCUMENTS

| | | | |
|---|---|---|---|
| 1,797,946 | 3/1931 | Eichel | 401/132 |
| 1,811,833 | 6/1931 | Simon | 401/132 |
| 1,947,722 | 2/1934 | Laub | 15/104.94 |
| 1,975,852 | 10/1934 | Laub | 132/84 R |
| 2,171,591 | 9/1939 | Minich | 206/63.5 |
| 2,512,001 | 6/1950 | Terry | 206/63.5 |
| 3,353,898 | 11/1967 | Lamberti | 132/83 R |
| 3,485,562 | 12/1969 | Hidden et al. | 401/134 |
| 4,117,841 | 10/1978 | Perrotta et al. | 401/132 |
| 4,291,697 | 9/1981 | Georgevich | 401/132 |

FOREIGN PATENT DOCUMENTS

| | | | |
|---|---|---|---|
| 401376 | 4/1966 | Switzerland | 132/84 R |
| 490841 | 11/1936 | United Kingdom | 15/104.94 |

*Primary Examiner*—William Price
*Assistant Examiner*—Brenda J. Ehrhardt

[57] ABSTRACT

A disposable dental package is provided and consists of a device for dispensing toothpaste from a packet into bristles of a toothbrush after the toothbrush and the packet are removed from a sanitary wrapper.

5 Claims, 4 Drawing Figures

DISPOSABLE TOOTH BRUSH

BACKGROUND OF THE INVENTION

The instant invention relates generally to dental products and more specifically it relates to a disposable toothbrush.

Numerous dental products have been provided in prior art that are adapted to be used and then disposed of. For example, U.S. Pat. Nos. 2,223,952; 3,316,580 and 3,880,281 all are illustrative of such prior art. While these units may be suitable for the particular purpose to which they address, they would not be as suitable for the purposes of the present invention as heretofore described.

SUMMARY OF THE INVENTION

A principle object of the present invention is to provide a disposable toothbrush that is small in size and comes with a small packet of toothpaste, both sealed in a sanitary plastic wrapper.

Another object is to provide a disposable toothbrush that can be obtained from vending machines and used in schools, hospitals, airlines, bus lines, homes, camping, etc.

An additional object is to provide a disposable toothbrush that has a built-in structure for dispensing the toothpaste from the packet to the bristles.

A further object is to provide a disposable toothbrush that is simple and easy to use.

A still further object is to provide a disposable toothbrush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
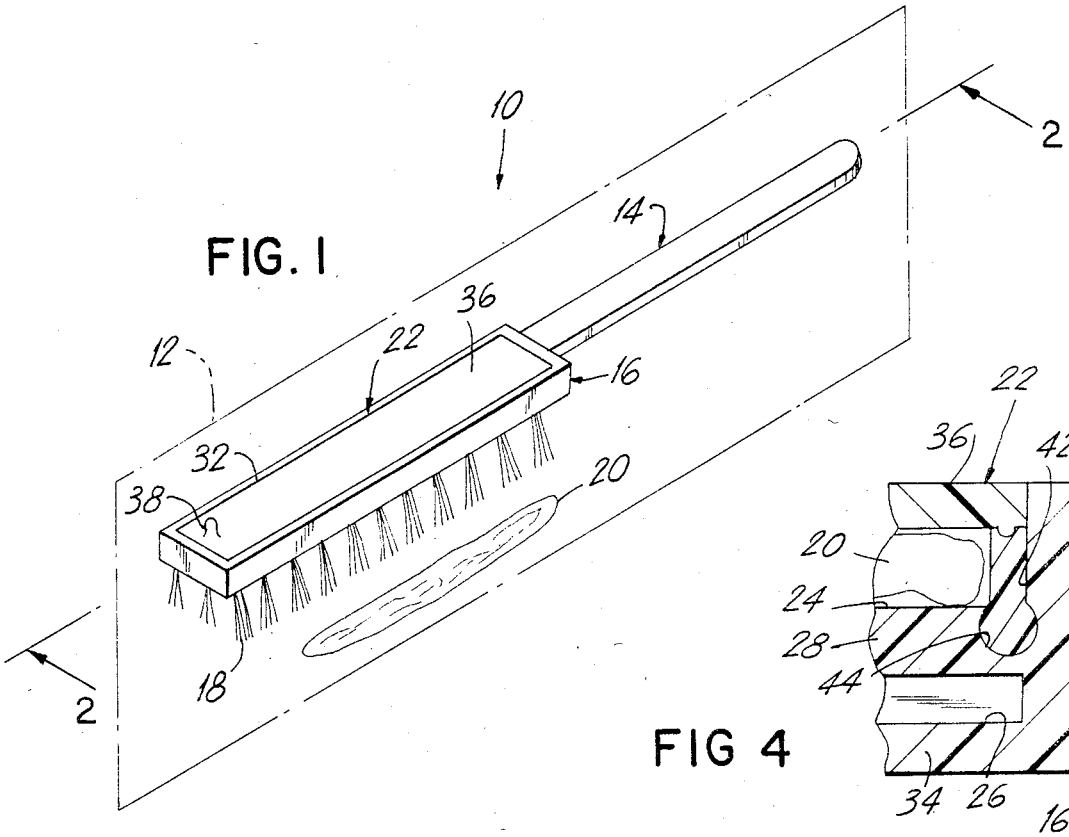
FIG. 1 is a perspective view of the invention sealed in a sanitary package shown in phantom.

Turning now descriptively to the drawings, in which similar reference characters denote similar elements throughout the several views FIG. 1 illustrates a disposable dental package 10 that contains a sanitary wrapper 12 shown in phantom, a toothbrush 14 that has a head 16 with a plurality of rows of bristles 18 and a small packet of toothpaste 20. The toothbrush 14 and packet 20 are sealed in the sanitary wrapper 12. A device 22 is provided for dispensing the toothpaste from the packet 20 into the bristles 18 of the toothbrush 14 after the toothbrush and packet are removed from the sanitary wrapper 12.

Figure 3:
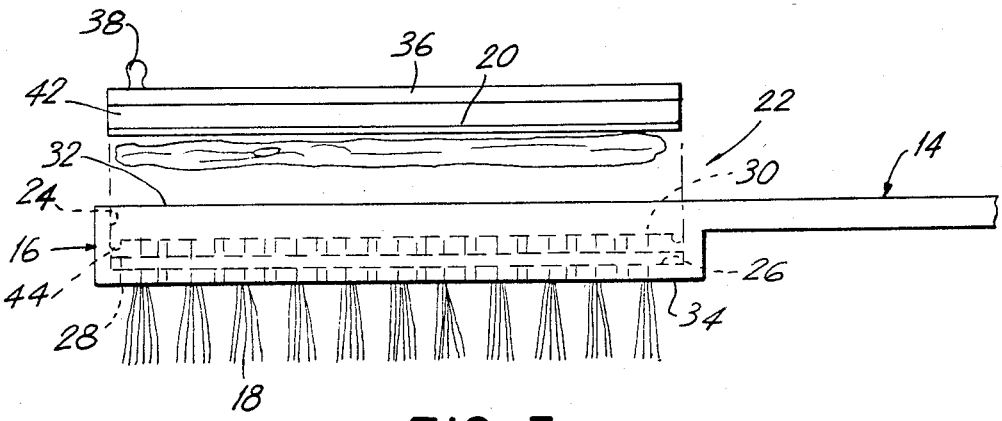
FIG. 3 is an exploded side view showing the removable lid and toothpaste packet to be inserted within the head portion.

FIGS. 12 and 3 best show the device 22 which consists of the head 16 having a first horizontal elongated hollow chamber 24 and a second horizontal elongated hollow chamber 26 separated by a perforated middle wall 28 therebetween. The wall 28 has a plurality of spikes 30 extending into the first horizontal elongated hollow chamber 24. The first elongated hollow chamber 24 has an open back 32 and the second elongated hollow chamber 26 has a perforated front wall 34.

A removable lid 36 is provided and has a finger grip tap 38. The lid 36 is placed into the open back 32 of the first horizontal elongated hollow chamber 24 after the toothpaste packet 20 is placed therein. When the lid is manually depressed as indicated by arrow 40 into the first horizontal elongated hollow chamber 24 the spikes 30 will puncture the packet 20 allowing the toothpaste to enter the second elongated hollow chamber 26 via the perforated middle wall 28 and out through the perforated front wall 34 into the bristles 18.

Figure 4:
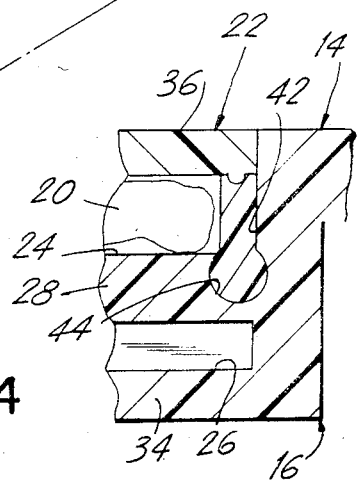
FIG. 4 is an enlarged cross sectional view as indicated by circle 4 in FIG. 2 of the peripheral flexible sealing grommet and retainer socket.
Figure 2:
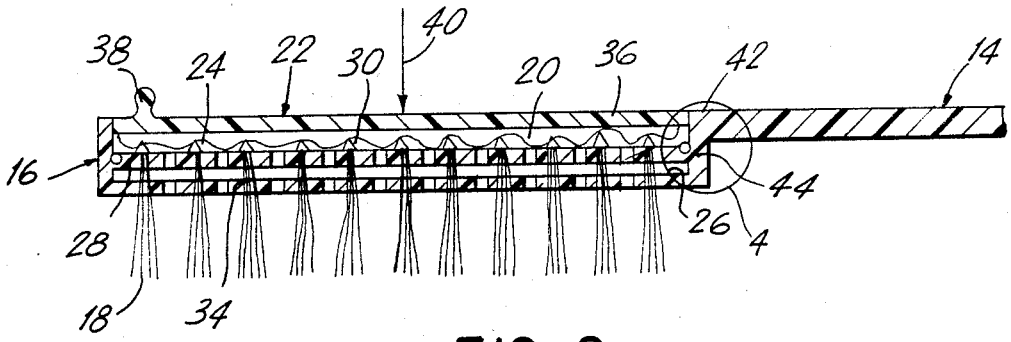
FIG. 2 is a cross sectional view taken along line 2—2 in FIG. 1, showing spikes to puncture toothpaste packet with upper and lower drain holes within the head portion.

As best seen in FIG. 4 the lid 36 has a peripheral flexible sealing grommet 42 affixed thereto. The first horizontal elongated hollow chamber 24 has a peripheral retainer socket 44. When the lid 36 is placed into the open back 32 of the first horizontal elongated hollow chamber 24 the grommet 42 will engage the socket 44 preventing the toothpaste from escaping out from around the lid 36 and allowing the lid to still be manually depressed.

The sanitary wrapper 12 is made of a plastic material while the toothpaste packet 20 is made of a soft plastic material. The toothbrush 14 and lid 36 are made of a firm plastic material while the flexible sealing grommet 42 is made of a pliable plastic material.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disposable dental package which comprises:

(a) a sanitary wrapper;

(b) a toothbrush having a head with a plurality of rows of bristles, said toothbrush sealed in said sanitary wrapper;

(c) a small packet of toothpaste sealed in said sanitary wrapper; and (d) means for dispensing said toothpaste from said packet into said bristles of said toothbrush after said toothbrush and said packet are removed from said sanitary wrapper, wherein said means for dispensing said toothpaste from said packet into said bristles of said toothbrush comprises:

(a) said head having a first horizontal elongated hollow chamber and a second horizontal elongated hollow chamber separated by a perforated middle wall therebetween having a plurality of spikes extending into said first horizontal elongated hollow chamber, said first horizontal elongated hollow chamber having an open back and said second horizontal elongated hollow chamber having a perforated front wall;

(b) a removeable lid having a finger grip tab, said lid is placed into said open back of said first horizontal elongated hollow chamber after said toothpaste packet is placed therein so that when said lid is manually depressed into said first horizontal elongated hollow chamber said spikes will puncture said packet allowing said toothpaste to enter said second elongated hollow chamber via said perforated middle wall and out through said perforated front wall into said bristles.

2. A disposable dental package as recited in claim 1, further comprising:

(a) said lid having a peripheral flexible sealing grommet affixed thereto; and (b) said first horizontal elongated hollow chamber having a peripheral retainer socket so that when said lid is placed into said open back of said first horizontal elongated hollow chamber said grommet will engage said socket preventing said toothpaste from escaping out from around said lid and allowing said lid to still be manually depressed.

3. A disposable dental package as recited in claim 2, wherein said sanitary wrapper is made of a plastic material.

4. A disposable dental package as recited in claim 3, wherein said toothpaste packet is made of a soft plastic material.

5. A disposable dental package as recited in claim 4, wherein said toothbrush and lid are made of a firm plastic material while said flexible sealing grommet is made of a pliable plastic material.

* * * * *